US007164870B2

(12) United States Patent
Satoh

(10) Patent No.: US 7,164,870 B2
(45) Date of Patent: Jan. 16, 2007

(54) METHOD AND APPARATUS FOR IMAGE FORMING CAPABLE OF EFFECTIVELY PERFORMING AN IMAGE FIXING

(75) Inventor: Naoki Satoh, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 58 days.

(21) Appl. No.: 10/987,153

(22) Filed: Nov. 15, 2004

(65) Prior Publication Data

US 2005/0123314 A1 Jun. 9, 2005

(30) Foreign Application Priority Data

Nov. 13, 2003 (JP) ..... 2003-384045
Aug. 19, 2004 (JP) ..... 2004-239338

(51) Int. Cl.
*G03G 15/20* (2006.01)

(52) U.S. Cl. ..... 399/69; 399/67; 219/216

(58) Field of Classification Search ..... 399/69, 399/67, 70

See application file for complete search history.

(56) References Cited

U.S. PATENT DOCUMENTS

| | | | | |
|---|---|---|---|---|
| 5,682,576 | A | 10/1997 | Sakai et al. | |
| 6,542,705 | B1 * | 4/2003 | Fujita et al. | 399/69 |
| 6,778,789 | B1 | 8/2004 | Cho et al. | |
| 6,806,445 | B1 | 10/2004 | Satoh | |
| 2002/0043523 | A1 * | 4/2002 | Fujita et al. | 219/216 |
| 2003/0086718 | A1 * | 5/2003 | Birumachi | 399/69 |
| 2003/0091359 | A1 * | 5/2003 | Cho et al. | 399/69 |
| 2003/0099479 | A1 * | 5/2003 | Nakafuji et al. | 399/70 |
| 2004/0258426 | A1 * | 12/2004 | Kishi et al. | 399/69 |

FOREIGN PATENT DOCUMENTS

| | | |
|---|---|---|
| JP | 2000-242132 | 9/2000 |
| JP | 2002-242132 | 9/2000 |
| JP | 2000-315567 | 11/2000 |
| JP | 2002-280146 | 9/2002 |
| JP | 2002-357966 | 12/2002 |
| JP | 2003-140484 | 5/2003 |
| JP | 2003-149993 | 5/2003 |
| JP | 2003-257590 | 9/2003 |

* cited by examiner

*Primary Examiner*—David M. Gray
*Assistant Examiner*—Ryan D. Walsh
(74) *Attorney, Agent, or Firm*—Oblon, Spivak, McClelland, Maier & Neustadt, P.C.

(57) ABSTRACT

An image forming apparatus includes an image forming mechanism and an image fixing mechanism which includes a fixing member, a capacitor, a charger, a first heater, a second heater, a sensor, and a controller. The charger charges the capacitor with a first electric power. The first heater heats-the fixing member with the first electric power from the capacitor. The second heater heats the fixing member with a second electric power. The sensor detects a temperature of the fixing member. The controller controls the second electric power to control the second heater, determines whether the temperature is needed to be increased based on the temperature, and starts supplying the first electric power to the first heater from the capacitor when the second electric power is of a greatest value and when the temperature is needed to be increased.

55 Claims, 9 Drawing Sheets

METHOD AND APPARATUS FOR IMAGE FORMING CAPABLE OF EFFECTIVELY PERFORMING AN IMAGE FIXING

BACKGROUND OF THE INVENTION

1. Field of the Invention

The present invention relates to a method and apparatus for image forming, and more particularly to a method and apparatus for image forming that is capable of effectively performing an image fixing.

2. Discussion of the Background

Conventionally, a fixing mechanism used for an electrophotographic image forming apparatus is provided with a heater. The heater is generally applied with a commercial AC (alternating current) power source and also an auxiliary power supply using a chargeable power supply such as an electric double layer capacitor. This is an attempt to make a quick rise of the heater possible as well as to increase an energy saving effect.

Such an image forming apparatus that uses a capacitor having a relatively large capacitance as an auxiliary power source can quickly supply a relatively large current to the fixing mechanism so as to be able to avoid degradation in image fixing when a power supply based on the AC commercial power source to the fixing mechanism is in short. However, after discharging the electric power to the fixing mechanism, a relatively large amount of electric power needs to be charged to the capacitor from the commercial AC power source and therefore it becomes not possible for the image forming apparatus to perform image forming at the same time. Thus, a downtime of the image forming apparatus is generated and consequently a user convenience is degraded.

SUMMARY OF THE INVENTION

This patent specification describes a novel image forming apparatus capable of effectively fixing a toner image onto a recording sheet. In one example, a novel image forming apparatus includes an image forming mechanism and an image fixing mechanism. The image forming mechanism is configured to form a toner image on a recording sheet. The image fixing mechanism includes a fixing member, a capacitor, a charger, a first heater, a second heater, a sensor, and a controller. The fixing member is configured to fix the toner image onto the recording sheet with heat and pressure. The charger is configured to charge the capacitor with a first electric power using a power source. The first heater is configured to receive the first electric power from the capacitor and to heat the fixing member. The second heater is configured to receive a second electric power from the power source to heat the fixing member. The sensor is configured to detect a temperature of the fixing member. The controller is configured to control an amount of the second electric power to control a heating value of the second heater. The controller determines whether the temperature of the fixing member is needed to be increased based on a variation of the temperature of the fixing member detected by the sensor. The controller starts supplying the first electric power to the first heater from the capacitor when the amount of the second electric power supplied to the second heater is of a greatest value and when the, temperature of the fixing member is determined to be needed to be increased.

Preferably, the power source may be a commercial power source.

Preferably, the first heater may include at least one heater element.

Preferably, the second heater may include at least one heater element.

Preferably, the controller may be configured to determine that the temperature of the fixing member is needed to be increased when the temperature of the fixing member is detected by the sensor as being lowered.

Preferably, the controller may be configured to supply the first electric power to the first heater from the capacitor during a time the second electric power is supplied to the second heater.

Preferably, the controller may be configured to supply the first electric power to the first heater from the capacitor, regardless of whether the second electric power is supplied to the second heater.

Preferably, the controller may be configured to vary an on-time duty in an on-and-off duty cycle of the second electric power to control the amount of the second electric power supplied to the second heater and to determine that the amount of the second electric power supplied to the second heater is of a greatest value when the on-time duty in the on-and-off duty cycle of the second electric power is varied to an allowable longest time period.

Preferably, the on-and-off duty cycle of the second electric power supplied to the second heater may be greater than an on-and-off duty cycle of the first electric power supplied to the first heater.

This patent specification further describes a novel image forming method capable of effectively fixing a toner image onto a recording sheet. In one example, a novel image forming method includes providing, arranging, charging, supplying, heating, detecting, controlling, determining, and starting. The providing step provides a first heater. The arranging step arranges a second heater. The charging step charges a capacitor with a first electric power using a power source. The supplying step supplies a second electric power from the power source to the second heater. The heating step heats a fixing member with the second electric power from the power source. The detecting step detects a temperature of the fixing member. The controlling step controls an amount of the second electric power to control a heating value of the second heater for heating the fixing member. The determining step determines whether the temperature of the fixing member is needed to be increased based on a variation of the temperature of the fixing member detected by the detecting step. The starting step starts supplying the first electric power to the first heater from the capacitor when the amount of the second electric power supplied to the second heater is of a greatest value and when the temperature of the fixing member is determined to be needed to be increased.

This patent specification further describes a novel heating apparatus capable of effectively heating. In one example, a novel heating apparatus includes a capacitor, a charger, a first heater, a second heater, a sensor, and a controller. The charger is configured to charge the capacitor with a first electric power using a power source. The first heater is configured to receive the first electric power from the capacitor and to heat a fixing member. The second heater is configured to receive a second electric power from the power source to heat the fixing member. The sensor is configured to detect a temperature of the fixing member. The controller is configured to control an amount of the second electric power to control a heating value of the second heater. The controller determines whether the temperature of the fixing member is needed to be increased based on a variation of the temperature of the fixing member detected by the sensor. The controller starts supplying the first electric power to the first heater from the capacitor when the amount of the second electric power supplied to the second heater is of a greatest value and when the temperature of the fixing member is determined to be needed to be increased.

This patent specification further describes a novel image fixing apparatus capable of effectively fixing a toner image onto a recording sheet. In one example, a novel image fixing apparatus includes a fixing member, a capacitor, a charger, a first heater, a second heater, a sensor, and a controller. The fixing member is configured to fix a toner image onto a recording sheet with heat and pressure. The charger is configured to charge the capacitor with a first electric power using a power source. The first heater is configured to receive the first electric power from the capacitor and to heat the fixing member. The second heater is configured to receive a second electric power from the power source to heat the fixing member. The sensor is configured to detect a temperature of the fixing member. The controller is configured to control an amount of the second electric power to control a heating value of the second heater. The controller determines whether the temperature of the fixing member is needed to be increased based on a variation of the temperature of the fixing member detected by the sensor. The controller starts supplying the first electric power to the first heater from the capacitor when the amount of the second electric power supplied to the second heater is of a greatest value and when the temperature of the fixing member is determined to be needed to be increased.

This patent specification further describes a novel image fixing method capable of effectively fixing a toner image onto a recording sheet. In one example, a novel image fixing method includes providing, arranging, charging, supplying, heating, detecting, controlling, determining, and starting. The providing step provides a first heater. The arranging step arranges a second heater. The charging step charges a capacitor with a first electric power using a power source. The supplying step supplies a second electric power from the power source to the second heater. The heating step heats a fixing member with the second electric power from the power source. The detecting step detects a temperature of the fixing member. The controlling step controls an amount of the second electric power to control a heating value of the second heater for heating the fixing member. The determining step determines whether the temperature of the fixing member is needed to be increased based on a variation of the temperature of the fixing member detected by the detecting step. The starting step starts supplying the first electric power to the first heater from the capacitor when the amount of the second electric power supplied to the second heater is of a greatest value and when the temperature of the fixing member is determined to be needed to be increased.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
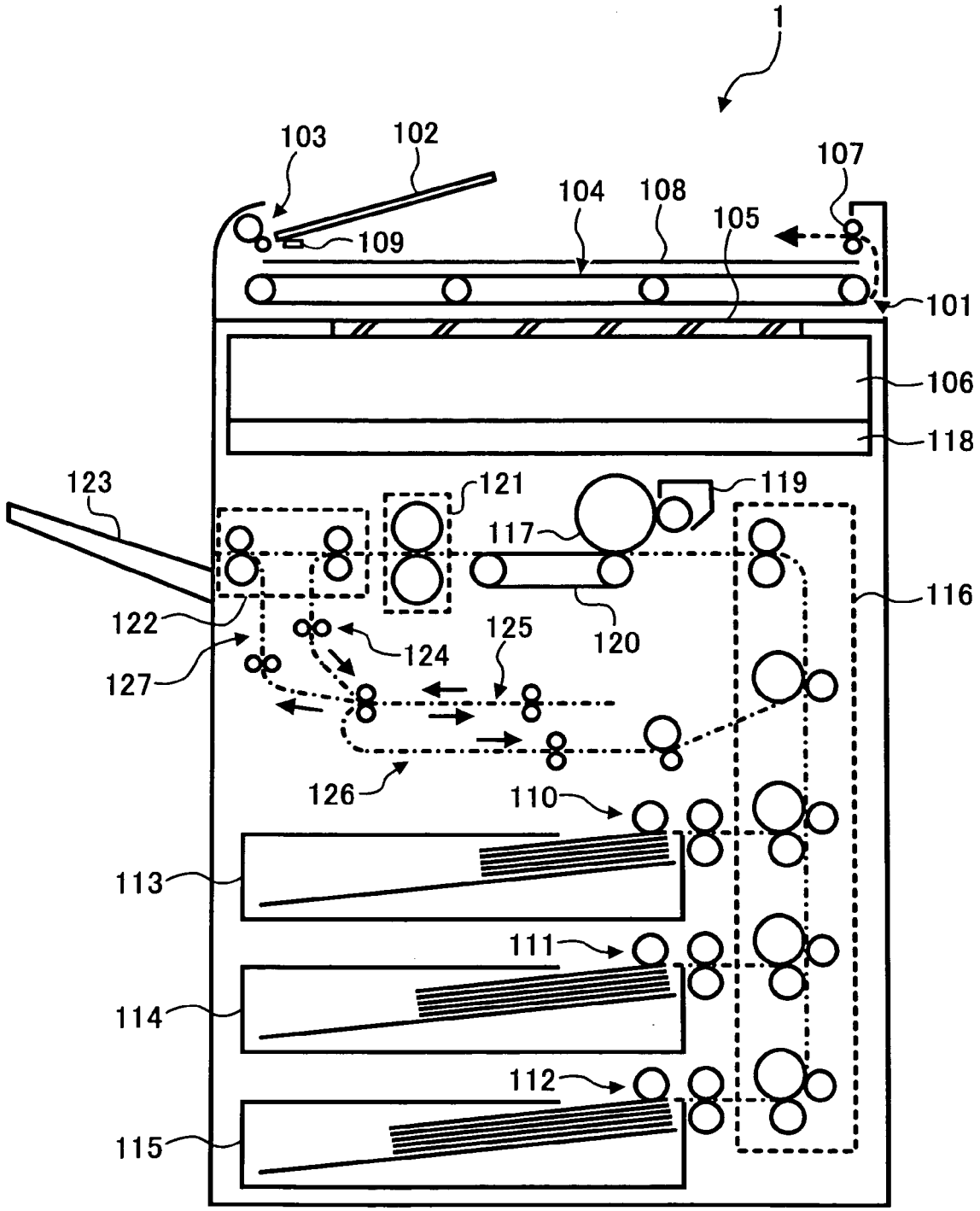
FIG. 1 is a schematic diagram illustrating an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 1 according to an exemplary embodiment of the present invention is described. FIG. 1 shows the image forming apparatus 1 which is a digital multi-function copier machine capable of executing not only a copying function but also various other functions including a printing function and a facsimile function. The image forming apparatus 1 of FIG. 1 is provided with an operation panel 150 (see FIG. 3) including a function select key (not shown) by which the above-mentioned functions of copying, printing, and facsimile are sequentially switched from one to another. By such key selection, the image forming apparatus 1 accordingly turns into respective operation modes of copying, printing, and facsimile.

As illustrated in FIG. 1, the image forming apparatus 1 includes an automatic document feeder (ADF) 101, an original input plate 102, a feed roller 103, a feed belt 104, a contact glass 105, an image reading unit 106, an original ejection roller 107, an original ejection tray 108, and an original input detector 109. The image forming apparatus 1 further includes first, second, and third sheet pickup mechanisms 110–112, and first, second, and third sheet cassettes 113–115. The image forming apparatus 1 further includes a vertical sheet transfer unit 116, a photosensitive member 117, an optical recording unit 118, a development unit 119, a sheet conveying belt 120, an image fixing unit 121, a sheet ejection unit 122, and a sheet ejection tray 123. The image forming apparatus 1 further includes a duplex-print entry unit 124, a switchback unit 125, a duplex-print transfer unit 126, and a reverse sheet ejection unit 127.

In the copy mode, for example, this image forming apparatus 1 operates in the following manner. To start a copy operation with the ADF 101, an original document having an image is placed with the image facing upwards on the original input plate 102 and a copy start key provided to the operation panel 150 (FIG. 3) is pressed. Upon a press of the copy start key, the original document is transferred to a predetermined reading position on the contact glass 105 by action of the feed roller 103 and the feed belt 104 which are driven by a feed motor (not shown). The ADF 101 has a function for counting the number of original document sheets each time transfer of an original document sheet is completed. After the image of the original document on the contact glass 105 is read by the image reading unit 106, the original document is removed and ejected to the original ejection tray 108 by the feed belt 104 and the original ejection roller 107 which is also driven by the feed motor.

When the original input detector 109 detects further original document sheets on the original input plate 102, the feed roller 103 and the feed belt 104 transfer in a similar manner a lowermost sheet in the original document sheets to the predetermined reading position on the contact glass 105. This lowermost sheet regarded as a next original sheet is removed from the contact glass 105 and is ejected to the original ejection tray 108 by the feed belt 104 and the original ejection roller 107 after the image of the next original sheet is read by the image reading unit 106.

The first, second, and third sheet pickup mechanisms 110–112 feed a recording sheet stocked in the sheet cassettes 113–115, respectively, which are selectively installed. When the first sheet cassette 113, for example, is selected, the first sheet pickup mechanism 110 feeds a recording sheet from a plurality of recording sheets stocked therein. The recording sheet fed from the first sheet cassette 113 is transferred to the photosensitive member 117 by the vertical sheet transfer unit 116. The photosensitive member 117 is driven to rotate by a main motor (not shown) and may include a photosensitive drum, for example.

The image data read from the original document by the image reading unit 106 is subjected to a predetermined image treatment by an image processing unit (not shown) and is then transmitted to the optical recording unit 118. By this time, the surface of the photosensitive member 117 is evenly charged with a charging unit (not shown). Then, the optical recording unit 118 converts the image data into optical information and forms an electrostatic latent image on the surface of the photosensitive member 117 according to the optical information converted from the image data of the original document. The electrostatic latent image formed on the surface of the photosensitive member 117 is then developed by the development unit 119 into a toner image.

The photosensitive member 117 and various components mostly arranged around the photosensitive member 117 including the optical recording unit 118 and the development unit 119 form an electro-photographic printing engine that forms an image with toner on a recording medium such as a recording paper sheet, for example.

The sheet conveying belt 120 functions as a conveyer of recording sheets and also performs transfer of toner images. The sheet conveying belt 120 is applied with a transfer bias from a power source (not shown). The sheet conveying belt 120 transfers the toner image carried on the photosensitive member 117 onto a recording sheet as it conveys the recording sheet at the same speed as the photosensitive member 117 rotates. The toner image transferred to the recording sheet is then fixed onto the recording sheet by the image fixing unit 121. Then, the recording sheet having the fixed toner image thereon is ejected to the sheet ejection tray 123 by the sheet ejection unit 122. After the image transfer to the recording sheet, the photosensitive member 117 is subjected to a cleaning process in which a cleaning unit (not shown) cleans residual toner off the surface of the photosensitive member 117.

The procedure described above is of a single-sided image forming mode to form an image on one side of a recording sheet. In a duplex image forming mode to form images on both sides of a recording sheet, the recording sheet is processed in a different way from the single-sided image forming mode, after the image transfer and fixing processes on a front side of the recording sheet. That is, after the image transfer and fixing processes, the recording sheet is directed to the duplex-print entry unit 124, but not to the sheet ejection tray 123, by the sheet ejection unit 122. The recording sheet is then reversed by the switchback unit 125 and is conveyed to the duplex-print transfer unit 126.

The recording sheet conveyed to the duplex-print transfer unit 126 is forwarded to the vertical sheet transfer unit 116 by the duplex-print transfer unit 126 and is then brought to the photosensitive member 117 by the vertical sheet transfer unit 116. Then, as in a similar manner performed in the single-sided image forming mode, the recording sheet receives on its back side another toner image formed on the photosensitive member 117 through the image transfer process. After that, the image fixing unit 121 fixes the toner image on the recording sheet, consequently forming a double-sided sheet. Such double-sided sheet is then ejected to the sheet ejection tray 123 by the sheet ejection unit 122.

To eject the double-sided sheet with face reversal, the double-sided sheet is directed to the duplex-print entry unit 124, but not to the sheet ejection tray 123, by the sheet ejection unit 122. After that, the double-sided sheet is reversed by the switchback unit 125 and is then conveyed to the reverse sheet ejection unit 127, but not to the duplex-print transfer unit 126. Then, the double-sided sheet is ejected the sheet ejection tray 123 by the sheet ejection unit 122.

In the print mode, the image forming procedure itself is substantially similar to that of the above-described copying mode, except for the source of the image data. That is, the image forming apparatus 1 generates the image data by reading the original document with the image reading unit 106 and provides the image data to the optical recording unit 118 in the copying mode; however, in the print mode, the image forming apparatus 1 receives image data from an external apparatus (not shown) with the optical recording unit 118.

Also, the image forming procedure in the facsimile mode is substantially similar to that of the copying mode, except for the source of the image data. In the facsimile mode, the image forming apparatus 1 performs a facsimile transmission operation to send image data read by the image reading unit 106 to a destination facsimile apparatus with a facsimile communications unit (not shown) provided to the image forming apparatus 1. Further, the image forming apparatus 1 performs a facsimile receiving operation to receive image data from a sending facsimile apparatus with the optical recording unit 118.

In addition, the image forming apparatus 1 is provided with a large capacity tray (LCT) and a finisher as well as the operation panel 150 (FIG. 3), which are not shown. The LCT can store a large number of recording sheets. The finisher includes a sorting unit, a punching unit, and a stapling unit. The operation panel 150 (FIG. 3) includes keys for instructing the above-described various operation modes, designating a copy magnification ratio, selecting between the first, second, and third sheet cassettes 113–115, and setting finishing modes, and indicators for indicating information to the operators.

Figure 2A:
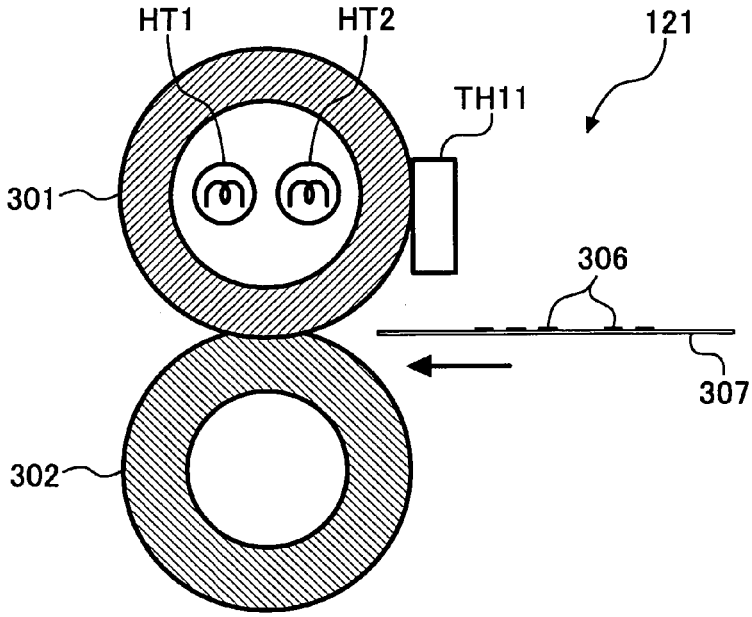
FIGS. 2A and 2B are schematic diagrams illustrating exemplary structures of a fixing mechanism used in the image forming apparatus of FIG. 1.
Figure 2B:
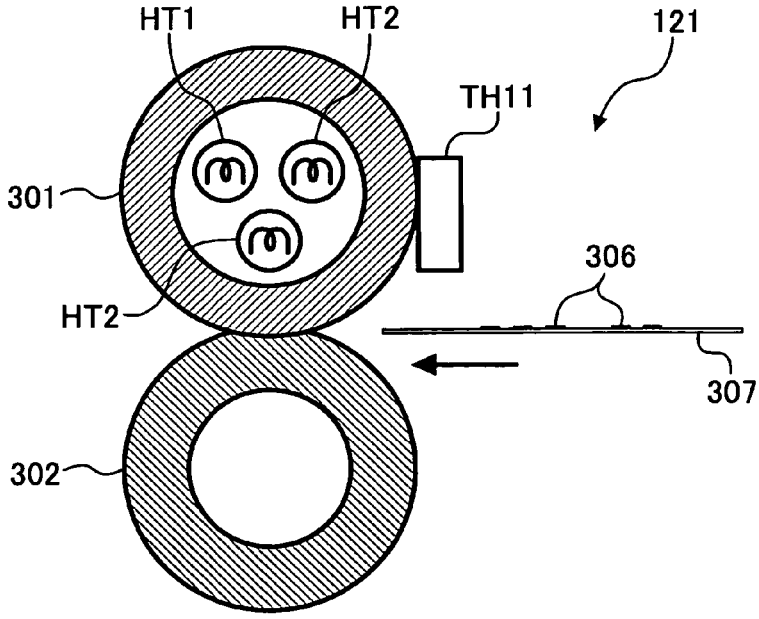

Referring to FIGS. 2A and 2B, an exemplary structure of the image fixing unit 121 is explained. As illustrated in FIG. 2A, the image fixing unit 121 includes a fixing roller 301 and a pressure roller 302. The fixing roller 301 includes a DC (direct current) heater HT1 and an AC (alternating current ) heater HT2, both provided inside the fixing roller 301 and heating the fixing roller 301 from inside. The fixing roller 301 further includes a temperature sensor TH11. The pressure roller 302 includes an elastic material made of silicon rubber or the like and presses the fixing roller 301 with a predetermined pressing force applied by a pressing mechanism (not shown). Both fixing member (i.e., the fixing roller 301) and pressing member (i.e., the pressure roller 302) are generally formed in a roller shape; however, it is possible to form one of them or both of them in a seamless-ring-shape.

The fixing roller 301 and the pressure roller 302 are driven to rotate by a driving mechanism (not shown). The temperature sensor TH11 may include a thermistor, for example, and is arranged in contact with the surface of the fixing roller 301 to detect a temperature of the surface of the fixing roller 301. This temperature is referred to as a fixing temperature. In FIGS. 2A and 2B, reference numerals 306 and 307 denote toner particles and the recording sheet, respectively. The toner particles 306 form the above-described toner image. The recording sheet 307 carrying the toner image made of the toner particles 306 are caused to pass through a nip portion formed between the fixing roller 301 and the pressure roller 302 and, during this process, the toner image made of the toner particles 306 is fixed onto the recording sheet 307 with heat and pressure.

The AC heater HT2 is a main heater to be energized to heat the fixing roller 301 to a reference target temperature Tt (see FIG. 8) when the fixing temperature is detected by the temperature sensor TH11 as below the reference target temperature.

The DC heater HT1 is applied with electric power from a capacitor (not shown) and is used as an auxiliary heater to heat the fixing roller 301 at several occasions. For example, the DC heater HT1 is activated at a power-on time of the image forming apparatus 1. The DC heater HT1 is also activated at a power-rise time when the-mode of the image forming apparatus 1 is changed from an energy-saving standby mode to a mode, such as the copying mode, in which image forming is available. Further, the DC heater HT1 heats the fixing roller 301 when the temperature of the fixing roller 301 is lowered during image forming and when the temperature of the fixing roller 301 cannot be raised sufficiently and effectively to the reference target temperature alone by the AC heater HT2.

As illustrated in FIG. 2B, a number of the DC heater HT1 and a number of the AC heater HT2 may be changed according to heating efficiency.

Figure 3:
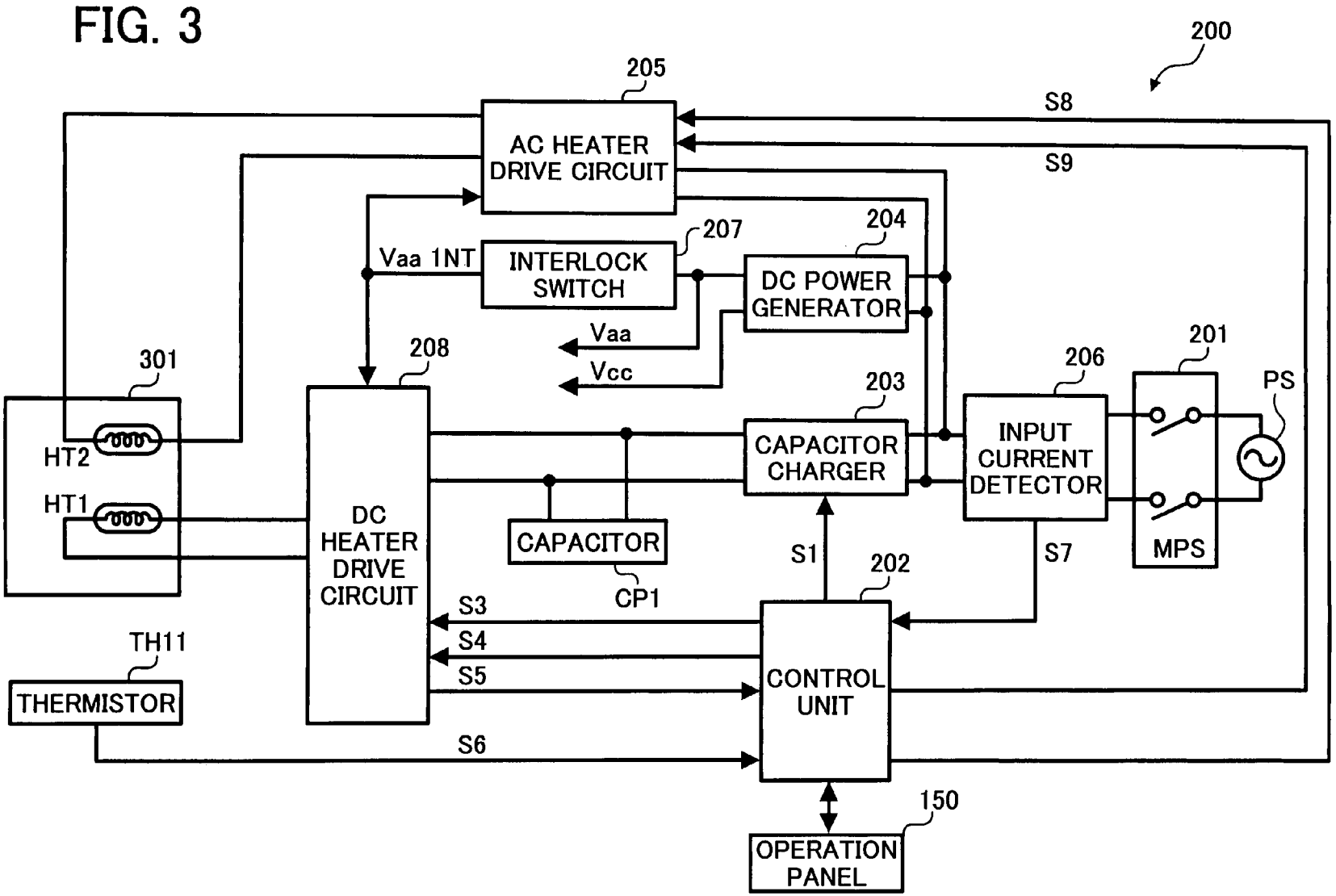
FIG. 3 is a schematic diagram illustrating an exemplary structure of a power control system used in the image forming apparatus of FIG. 1.

Referring to FIG. 3, an exemplary structure of a power control system 200 for the image fixing unit 121 is explained. The power control system 200 is included in the image forming apparatus 1. As illustrated in FIG. 3, the power control system 200 includes a main power switch (MPS) 201, a power control unit 202, a capacitor CP1, and a capacitor charger 203. The power control system 200 further includes a DC (direct current) power generator 204, an AC (alternating current) heater drive circuit 205, an input current detector 206, an interlock switch 207, and a DC (direct current) heater drive circuit 208. The main power switch 201 switches on and off a supply of an AC (alternating current) power from an AC (alternating current) power source PS (e.g., a commercial alternating current) into the power control system 200. The power control unit 202 controls an entire operation of the power control unit 202. The capacitor CP1 supplies power to the DC heater HT1. The capacitor charger 203 charges the capacitor CP1. The DC power generator 204 generates DC (direct current) powers used by the image forming apparatus 1. The AC heater drive circuit 205 supplies the AC power to the AC heater HT2. The input current detector 206 detects an input current input from the AC power source PS. The interlock switch 207 switches on and off with interlocking with doors of casing (not shown) of the image forming apparatus 1. The DC heater drive circuit 208 supplies DC power to the DC heater HT1.

The AC power source PS supplies the AC power to the DC power generator 204, the AC heater drive circuit 205, and the capacitor charger 203 through the main power switch 201 and the input current detector 206.

The control unit 202 mainly controls the operations of the capacitor charger 203, the AC heater drive circuit 205, and the DC heater drive circuit 208. More specifically, the control unit 202 sends a control signal S1 to the capacitor charger 203 to control a charging operation of the capacitor charger 203 to charge the capacitor CP1. The control unit 202 also sends control signals S3 and S4 to the DC heater drive circuit 208 to control a DC heater drive operation of the DC heater drive circuit 208 to drive the DC heater HT1. The control unit 202 further sends control signals S8 and S9 to the AC heater drive circuit 205 to control an AC drive operation of the AC heater drive circuit 205 to drive the AC heater HT2. The control unit 202 estimates a number of original document sheets placed on the input original plate 102 of the ADF 101 based on a detection signal indicative of a height of the original document sheets sent from a sensor (not shown) provided to the ADF 101. The control unit 202 further estimates a time period needed for the copy job in each of a high-speed mode and a low-speed mode based on the calculated number of original document sheets, a number of copies previously instructed through the operation panel 150, and a time period necessary for a print in each of the high-speed and low-speed modes.

The input current detector 206 is arranged between the main power switch 201 and circuitry including the capacitor charger 203, the DC power generator 204, and the AC heater drive circuit 205. The input current detector 206 detects an input current of the AC power input via the main power switch 201 and sends a control signal S7 to the control unit 202. This input current of the AC power varies depending on operational statuses of the capacitor charger 203, the DC power generator 204, the AC heater drive circuit 205, and the image forming apparatus 1.

The DC power generator 204 generates power voltages Vcc and Vaa based on the AC power input via the main power switch 201. The power voltage Vcc is mainly used by a control system and the power voltage Vaa is mainly used by a drive system and circuitry requiring medium and high power voltages, in the image forming apparatus 1.

The interlock switch 207 switches on and off with interlocking with doors of casing (not shown) of the image forming apparatus 1. That is, members for driving mechanisms and members for being applied with medium and high power voltages are usually protected inside the casing and can be seen by opening a protection door provided to the casing. When such protection door is opened, the interlock switch 207 is activated to stop the operations of the members for driving mechanisms and to cut off the medium and high power voltages to be supplied to the members that use these voltages. The interlock switch 207 is applied with a part of the power voltage Vaa generated by the DC power generator 204. The power voltage Vaa applied to the interlock switch 207 is further applied to the AC heater drive circuit 205 and the DC heater drive circuit 208 through the interlock switch 207. This power voltage Vaa transmitted from the interlock switch 207 to the AC heater drive circuit 205 and the DC heater drive circuit 208 is referred to as a power voltage VaaINT for the convenience sake.

The AC heater drive circuit 205 energizes and stops to energize the AC heater HT2 in accordance with the control signals S8 and S9 sent from the control unit 202.

The capacitor charger 203 is connected to the capacitor CP1, and charges the capacitor CP1 in accordance with the control signal S1 sent from the control unit 202.

The capacitor CP1 includes an electric double layer capacitor having a relatively large amount of capacitance, and is connected to the capacitor charger 203 and the DC heater drive circuit 208. The capacitor CP1 is charged by the capacitor charger 203, and the energy charged to the capacitor CP1 is supplied to the DC heater HT1 by a switching operation of the DC heater drive circuit 208.

The DC heater drive circuit 208 discharges the energy charged to the capacitor CP1 in accordance with the control signals S3 and S4 so that the DC heater HT1 is turned on and off.

The thermistor TH11 is arranged in the vicinity of the fixing roller 301 and outputs to the control unit 202 a detection signal S6 having a voltage in accordance with the surface temperature of the fixing roller 301. Since the thermistor TH11 varies its resistance in response to the temperature, it outputs a voltage varying in response to a change of temperature so that the control unit 202 detects the surface temperature of the fixing roller 301 according to the control signal S6.

Figure 4:
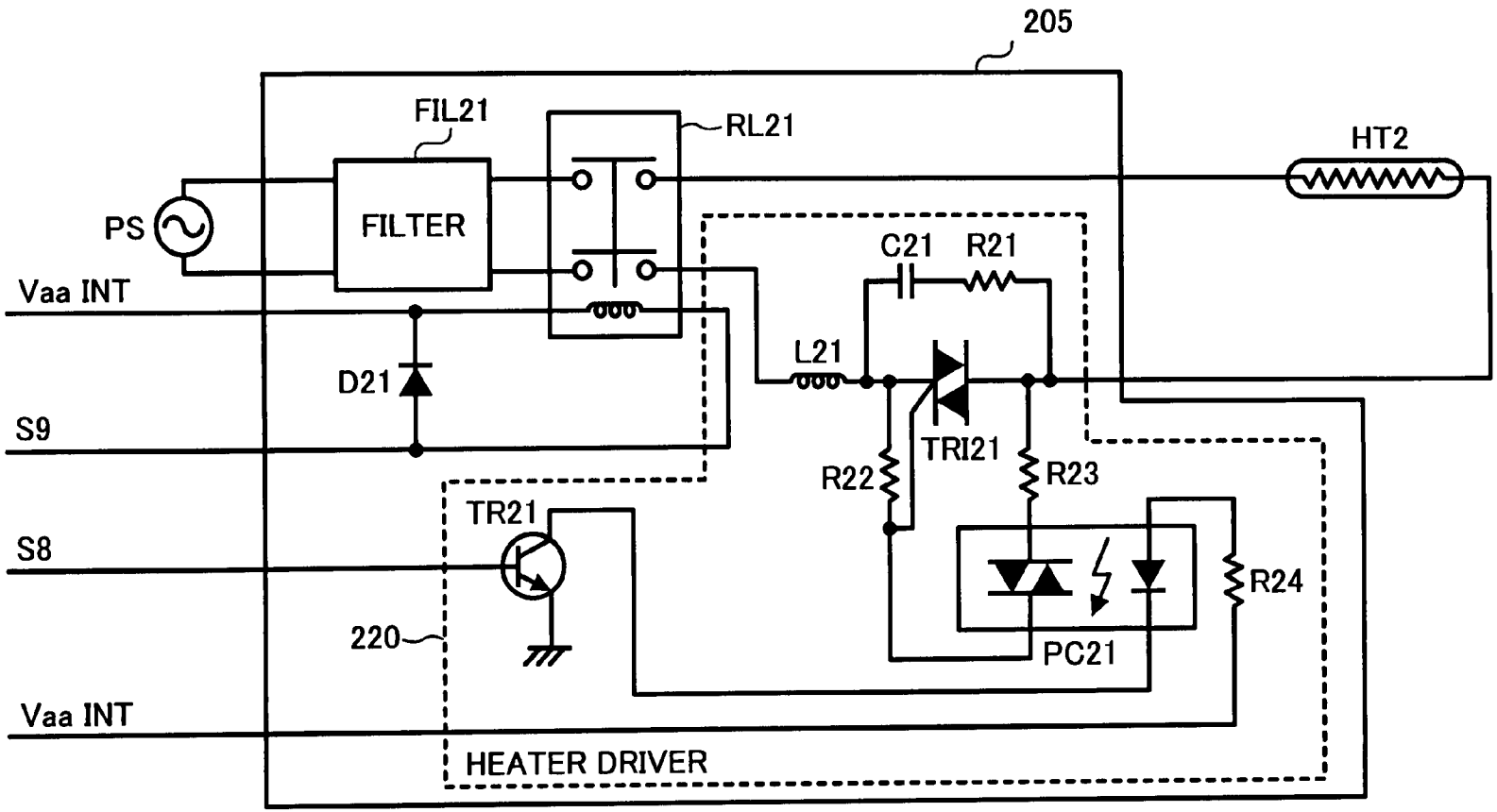
FIG. 4 is a schematic diagram illustrating an exemplary structure of an AC heater drive circuit used in the image forming apparatus of FIG. 1.

FIG. 4 illustrates an exemplary structure of the AC heater drive circuit 205. As illustrated, the AC heater drive circuit 205 includes a filter FIL21, a fixing relay RL21, a diode D21, and a heater driver 220. The filter FIL21 eliminates electric noises from the input AC power. The fixing relay RL21 is for a safety protection and is activated on and off in accordance with the control signal S9 input from the control unit 202. The diode D21 protects the relay RL21 from a counter electromotive force. The heater driver 220 drives the AC heater HT2 on and off in accordance with the control signal S8 input from the control unit 202.

The AC power source PS is connected to one end of the AC heater HT2 through the filter FIL21 and the fixing relay RL21. Another end of the AC heater HT2 is connected to the heater driver 220.

As illustrated in FIG. 4, the heater driver 220 includes a triac TRI21, a photocoupler PC21, a transistor TR21, a capacitor C21, resistors R21–R24, and an inductor L21. The triac TRI21 activates the AC power source PS on and off. The photocoupler PC21 turns on the gate of the triac TRI21, and isolates signals from the control unit 202 locating in a secondary circuit. The transistor TR21 drives an LED (light-emitting diode) arranged at a light emission side of the photocoupler PC21. The capacitor C21 and the resistor R21 form a snubber circuit for absorbing electric noises. The inductor L21 also absorbs electric noises. The resistor R22 protects a follow current. The resistors R23 and R24 limits a current flowing through the photocoupler PC21.

In the AC heater drive circuit 205 thus structured, the AC heater HT2 is energized when the fixing relay RL21 for the safety protection and the gate of the transistor TR21 are both turned on.

The control unit 202 controls the AC heater HT2 to turn on and off by asserting and negating the control signal S8 to be applied to the gate of the transistor TR21 with keeping the control signal S9 asserted.

Figure 5:
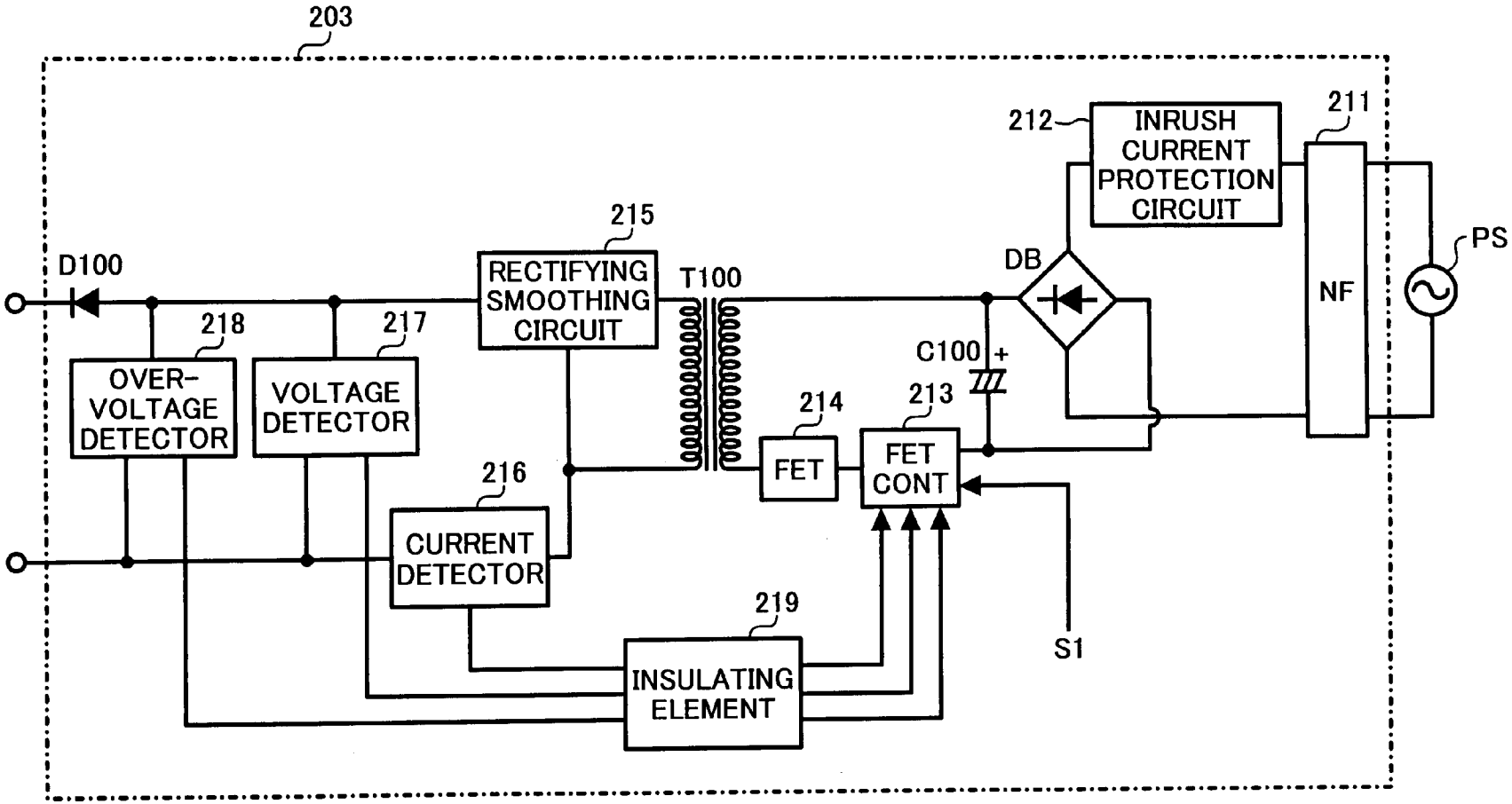
FIG. 5 is a schematic diagram illustrating an exemplary structure of a capacitor charger used in the image forming apparatus of FIG. 1.

FIG. 5 illustrates an exemplary structure of the capacitor charger 203. As illustrated, the capacitor charger 203 includes a noise filter (NF) 211, an inrush current protection circuit 212, a diode bridge DB, a capacitor C100, an FET (field-effect transistor) controller 213, an FET (field-effect transistor) 214, and a transformer T100. The capacitor charger 203 further includes a rectifying smoothing circuit 215, a current detector 216, a voltage detector 217, an overvoltage detector 218, and an insulating element 219.

The noise filter 211 eliminates electric noises from the input AC voltage. The inrush current protection circuit 212 protects an inrush current. The diode bridge DB rectifies the AC voltage input through the inrush current protection circuit 212. The capacitor C100 smoothes the rectified AC voltage. The FET controller 213 controls the switching operation of the FET 214 to control the charging of the capacitor CP1 (see FIG. 3). The FET 214 energized the transformer T100 on and off. The transformer T100 raises the input voltage. The rectifying smoothing circuit 215 rectifies and smoothes an output from the transformer T100 in a secondary circuit so as to convert the output into a DC (direct current) output. The current detector 216 detects a value of the DC output current. The voltage detector 217 detects a value of the DC output voltage. The overvoltage detector 218 detects an overvoltage of the DC output voltage so as not to apply an overvoltage to the capacitor CP1. The diode D100 protects a reverse current flow from the capacitor CP1.

The AC voltage input from the AC power source PS is subjected to the noise elimination by the noise filter 211 and subsequently to the inrush current protection by the inrush current protection circuit 212. Then, the AC voltage is rectified by the diode bridge DB and is smoothed by the capacitor C100. As a result, the AC voltage is converted into a DC voltage which is then input to the primary side of the transformer T100. The FET controller 213 starts controlling the switching operation of the FET 214 to charge the capacitor CP1 when the control signal S1 input from the control unit 202 is asserted. The FET controller 213 performs a constant current control, a constant voltage control, and a constant electric power control for charging the capacitor CP1 by controlling the switching operation of the FET 214 based on the detection signals sent from the current detector 216, the voltage detector 217, and the overvoltage detector 218 via the insulating element 219. In general, charging the capacitor CP1 under a constant electric power control can reduce a charging time although charging the capacitor CP1 is preferably performed with a constant current.

The transformer T100 is driven on and off by the FET 214 to raise the voltage input to the primary side and to output a raised voltage from the secondary side. The output voltage output from the secondary side of the transformer T100 is rectified and smoothed by the rectifying smoothing circuit 215 and is output to the capacitor CP1 via the diode D100. The output voltage from the secondary side of the transformer T100 after the rectifying smoothing circuit 215 is monitored by the current detector 216, the voltage detector 217, and the overvoltage detector 218 so that the respective detection signals based on the detected current value, voltage value, and overvoltage value are input to the FET controller 213 via the insulating element 219.

Figure 6:
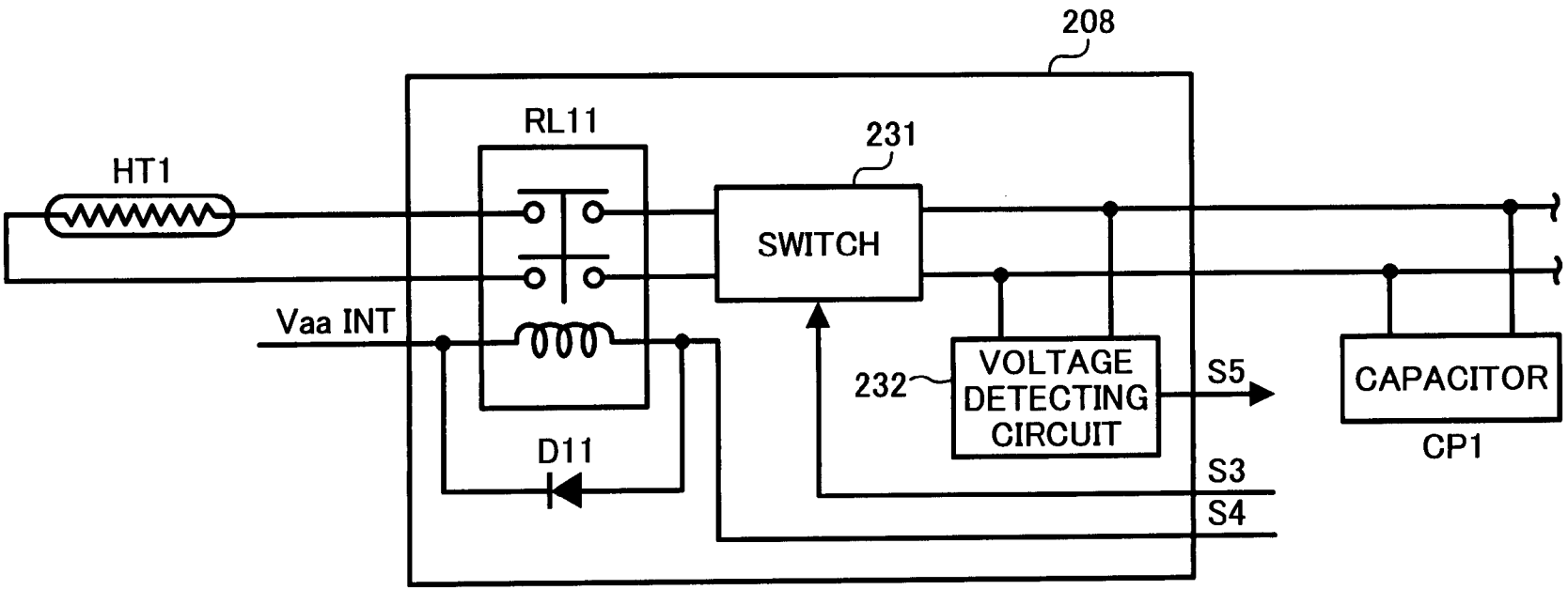
FIG. 6 is a schematic diagram illustrating an exemplary structure of a DC heater drive circuit used in the image forming apparatus of FIG. 1.

FIG. 6 illustrates an exemplary structure of the DC heater drive circuit 208. As illustrated, the DC drive circuit 208 includes a switch 231, a fixing relay RL11, a diode D11, and a voltage detecting circuit 232. The switch 231 switches between charging and discharging. The fixing relay RL11 is for a safety protection of circuitry. The diode D11 protects generation of a counter electromotive force to the fixing relay RL11. The voltage detecting circuit 232 detects the voltage across the capacitor CP1.

The capacitor CP1 is connected to the switch 11 to which the fixing relay RL11 is connected. The switch 231 is turned on and off according to the control signal S3 input form the control unit 202. Similarly, the fixing relay RL11 is turned on and off according to the control signal S4 input from the control unit 202.

When the switch 231 and the fixing relay RL11 are both turned on, the energy charged to the capacitor CP1 is discharged and is supplied to the DC heater HT1.

The voltage detecting circuit 232 detects the voltage across the capacitor CP1 and outputs to the control unit 202 a control signal S5 having a voltage according to a detection result. The control unit 202 continuously monitors the control signal S5 to observe a status of charging of the capacitor CP1.

Figure 7:
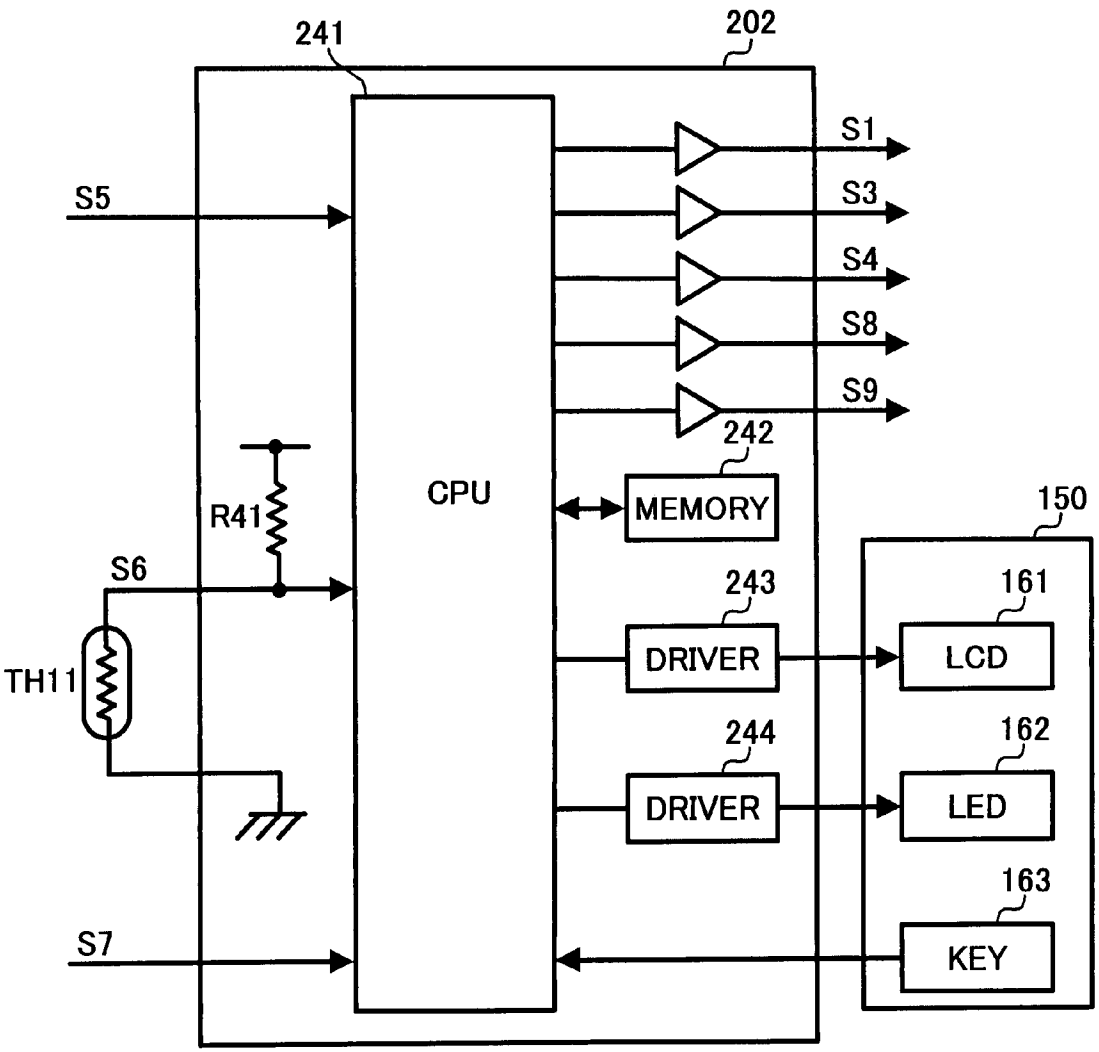
FIG. 7 is a schematic diagram illustrating an exemplary structure of a power control unit used in the image forming apparatus of FIG. 1.

FIG. 7 illustrates an exemplary structure of the control unit 202. As illustrated, the control unit 202 includes a CPU (central processing unit) 241, a memory 242, a resistor R41, and drivers 243 and 244. The CPU 241 communicates with the memory 242 which stores programs and data needed to control the image forming apparatus 1, and controls the mechanisms for image forming as well as the power control system 200 based on the programs stored in the memory 242.

The CPU 241 receives the control signals S5–S7; the control signal S5 is an analog voltage signal representing a voltage across the capacitor CP1 detected by the voltage detecting circuit 232 of the DC heater drive circuit 208, the control signal S6 is an analog signal divided by the thermistor TH11 and the resistor R41 to detect the surface temperature with respect to the fixing roller 301, and the control signal S7 is an analog voltage signal representing an input current from the AC power source PS detected by the input current detector 206.

The CPU 241 outputs the control signals S1, S3, and S4; the control signal S1 activate the capacitor charger 203 to charge the capacitor CP1, the control signal S3 activates the switch 231 to turn on and off, and the control signal S4 activates the fixing relay RL11 to turn on and off. In addition, the CPU 241 outputs the control signals S8 and S9; the control signal S8 activates the heater driver 220 to turn on and off, and the control signal S9 activates the fixing relay RL21 to turn on and off.

Further, the CPU 241 is configured to control the operation panel 150 and monitors operator's input with a key 163 provided to the operation panel 150. The driver 243 is a driver activated by the CPU 241 to drive an LCD (liquid crystal display) provided to the operation panel 150. The driver 244 is a driver activated by the CPU 241 to drive an LED (light-emission diode) provided to the operation panel 150.

Next, an exemplary control operation performed by the control unit 202 is explained with reference to FIGS. 8 and 9. The image forming apparatus 1 performs a heat process with respect to the image fixing unit 121 as quick as possible by using the powers from the capacitor CP1 and the AC power source PS to activate the DC heater HT1 and the AC heater HT2.

Figure 8:
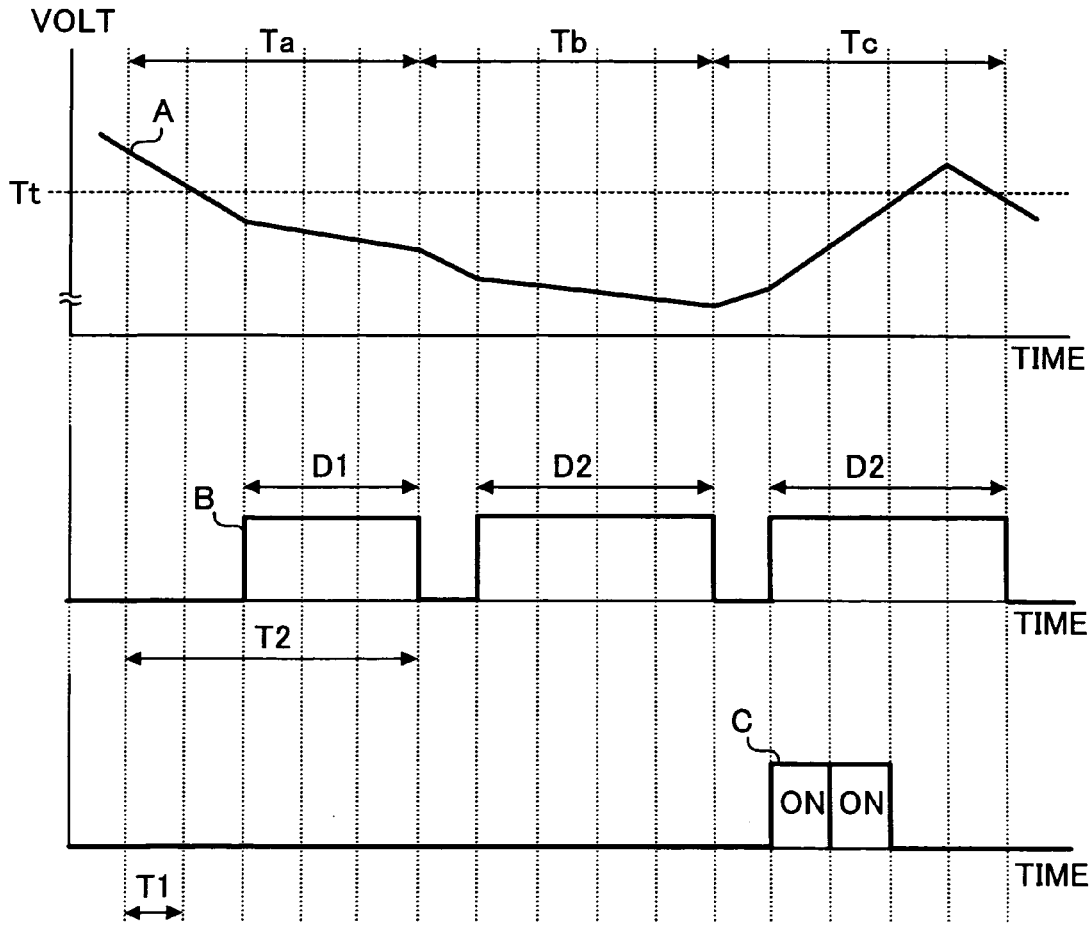
FIG. 8 is time charts connected to each other for explaining relationships among a surface temperature of a fixing roller, an on-time duty length for an AC heater, and an on-time duty length for a DC heater.

FIG. 8 demonstrates relationships among a surface temperature A of the fixing roller 301 detected by the temperature sensor TH11, an on-time duty B of the AC heater HT2, and an on-time duty C of the DC heater HT1.

In FIG. 8, a temperature value Tt refers to a target fixing temperature for the surface temperature of the fixing roller 301 to be detected by the temperature sensor TH11. The control unit 202 controls the circuit to energize the AC heater HT2 when the surface temperature of the fixing roller 301 detected by the temperature sensor TH11 is lowered below the target fixing temperature Tt, so that the surface temperature of the fixing roller 301 detected by the temperature sensor TH11 is maintained not below the target fixing temperature Tt.

In FIG. 8, a time period T1 is a cycle to control the DC heater HT1 to turn on and off, and a time period T is a cycle to control the AC heater HT2 to turn on and off. The time period T1 is shorter than the time period T2 and therefore the DC heater HT1 can be controlled to turn on and off in a shorter cycle than the AC heater HT2.

The temperature control of the AC heater HT2 is executed each time the time period T2 lapses by determining an on-time duty within the on-and-off duty cycle for the AC heater HT2 based on the surface temperature of the fixing roller 301 detected by the thermistor TH11. That is, the on-time duty of the on-and-off duty cycle for the AC heater HT2 is increased when the surface temperature of the fixing roller 301 is detected as being lowered and is decreased when the surface temperature is detected as being raised.

The on-time duty of the on-and-off duty cycle for the AC heater HT2 represents a time period of heating the AC heater HT2 within a predetermined time period, i.e., the on-and-off duty cycle. For example, when the predetermined time period (i.e., the on-and-off duty cycle; Ta, Tb, and Tc in FIG. 8) is one second and a frequency of the commercial AC power source PS is 50 Hz., a half-wave frequency of the commercial AC power source is 10 ms and therefore one hundred half-waves are generated in one second. Therefore, a 50% on-time duty of the on-and-off duty cycle is a case in which the AC heater HT2 is turned on by fifty half-waves in one on-and-off duty cycle.

In the example of FIG. 8, the on-time duty of the on-and-off duty cycle is arbitrarily changed as indicated by exemplary time periods D1 and D2. As shown in FIG. 8, the time period D2 is longer than the time period D1 and therefore allows application of a greater electric power to the AC heater HT2 than the time period D1. The change of the on-time duty may not be limited to two stages such as the time periods D1 and D2, and it can be changed in three or more stages or in a continuous manner. The on-time duty, specifically the time period D2 is a value predetermined when the image forming apparatus 1 is manufactured.

The two-stage change of the on-time duty using the time periods D1 and D2 is an example for a convenience sake and, in practice, a thirty-stage on-time duty change is applied, for example. In addition, the time period D2 is not limited to a single value in practice. That is, two different time periods D2*a* and D2*b*, for example, can selectively be used: a time period D2*a* used as an on-time duty when the image reading unit 106 is activated and a time period D2*b* used as another on-time duty when the image reading unit 106 is not activated. This is because an allowable largest electric power to be applied to the fixing roller 301 is different between the following two exemplary cases. In one case, the image forming apparatus 1 reads a thousand of original document sheets with the ADF 101 and the image reading unit 106 and performs the image forming operation on these original document sheets in the copy mode. In another case, the image forming apparatus 1 read one original document sheet with the image reading unit 106 and performs the image forming operation thousand times on this original document sheet in the copy mode. Another example of making the allowable largest electric power different is a use of peripheral equipment such as a stapler, for example. Therefore, it is preferable to prepare a plurality of different time periods D2 and to selectively use them.

In FIG. 8, the surface temperature A is lowered when the fixing roller 301 is energized at the on-time duty of the time period D1 during a time Ta. Then, during a time Tb, the control unit 202 increases the on-time duty to the time period D2 in order to raise the surface temperature A to the target fixing temperature Tt. By changing the on-time duty from the time period D1 to the time period D2, an amount of electric power applied to the fixing roller 301 is increased and, as a result, an average descending curb of the surface temperature A becomes more gentle in the time Tb than in the time Ta. But, the surface temperature A still descends in the time Tb and the on-time duty of heating the AC heater HT2 is needed to be further increased; however, the time period D2 is the largest time period predetermined for the on-time duty. Therefore, when the surface temperature A still descends with the application of the time period D2 for the on-time duty, an application of heating the DC heater HT1 is needed during a time Tc.

In this case, since the on-time duty is set to the time period D2 during the time Tb, the control unit 202 starts supplying electric power to the DC heater HT1 from the capacitor CP1 using the control signals S3 and S4. As a result, the surface temperature A raises in a time Tc. When the surface temperature A reaches the target fixing temperature Tt, the control unit 202 stops supplying electric power to the DC heater HT1. When the surface temperature A exceeds the target fixing temperature Tt, the control unit 202 first turns off the DC heater HT1 and then the AC heater HT2 so as to decrease an on-time length of the DC heater HT1 as much as possible.

Figure 9:
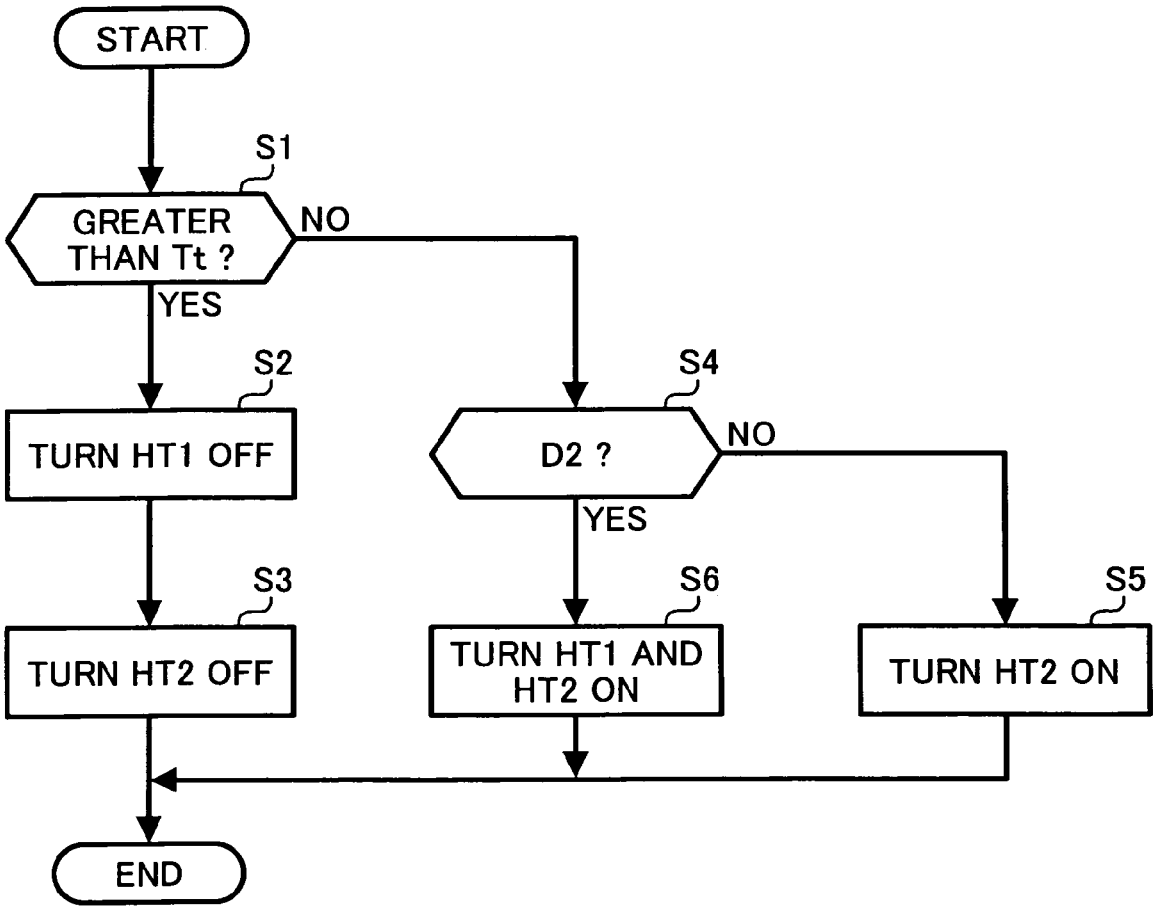
FIG. 9 is a flowchart for explaining an exemplary procedure of an image fixing control performed by the power control unit of FIG. 7 included in the image forming apparatus of FIG. 1.

Referring to FIG. 9, an exemplary procedure of the above-described heater control performed by the control unit 202 is explained. In FIG. 9, the control unit 202 determines whether the detected surface temperature of the fixing roller 301 is greater than the target fixing temperature Tt, in Step S1. When the detected surface temperature of the fixing roller 301 is determined as being greater than the target fixing temperature Tt and the determination result in Step S1 is YES, the control unit 202 turns off the DC heater HT1 in Step S2 and subsequently the AC heater HT2 in Step S3.

When the detected surface temperature of the fixing roller 301 is determined as not being greater than the target fixing temperature Tt and the determination result in Step S1 is NO, the control unit 202 proceeds to Step S4 to determine whether the AC heater HT2 is heated with the on-time duty of the time period D2. When the AC heater HT2 is determined as heated with the on-time duty of the time period D2 and the determination result of Step SS4 is YES, the control unit 202 proceeds to Step S6 to turn on the DC heater HT1 in addition to the AC heater HT2 being heated with the on-time duty of the time period D2. Then, the control unit 202 ends the process.

When the AC heater HT2 is determined as not heated with the on-time duty of the time period D2, the control unit 202 proceeds to Step S5 to energize the AC heater HT2 with the on-time duty of the time period D2. Then, the control unit 202 ends the process.

As described above, the control unit 202 switches the on-time duty between the time periods D1 and D2 depending upon the statuses of the surface temperature of the fixing roller 301 whether it declines, rising, or staying flat, so as to suitably change an amount of electric power to be supplied to the AC heater HT2.

There is an erroneous status in which the fixing roller 301 is applied with an insufficient amount of electric power such that the fixing roller 301 may cause an erroneous fixing. In such an erroneous status, the control unit 202 energizes the AC-heater HT2 with the on-time duty of the time period D2 in Step S5 and, via repeated Steps S1 and S4, additionally activates the DC heater HT1 to quickly supply a sufficient amount of electric power to the fixing roller 301. Thereby, the surface temperature of the fixing roller 301 reaches and exceeds the target fixing temperature Tt.

Although the control unit 202 is configured to supply the electric power to the DC heater HT1 from the capacitor CP1 during the time the AC heater HT2 is energized, the control unit 202 may supply the electric power to the DC heater TH1 from the capacitor CP1 also during the time the AC heater HT2 is not energized.

As an alternative, the DC heater HT1 and the AC heater HT2 may be a unified heater.

As another alternative, as described above, the AC heater HT2 can be formed with a plurality of AC heater elements (e.g., two heater elements).

In this way, the control unit 202 controls heating of the DC heater HT1 as an auxiliary heater in addition to the AC heater HT2 in several events. For example, it is executed at a power-on time, the above-mentioned erroneous status of the surface temperature, and so on.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. JPAP2001-081211 filed on Mar. 21, 2001 and No. 2002-60796 filed on Mar. 6, 2002, in the Japanese Patent Office, the entire contents of which are incorporated by reference herein.

What is claimed is:

1. An image forming apparatus, comprising:

an image forming mechanism configured to form a toner image on a recording sheet; and an image fixing mechanism comprising:

a fixing member configured to fix the toner image onto the recording sheet with heat and pressure;

a capacitor;

a charger configured to charge the capacitor with a first electric power using a power source;

a first heater configured to receive the first electric power from the capacitor and to heat the fixing member;

a second heater configured to receive a second electric power from the power source to heat the fixing member;

a sensor configured to detect a temperature of the fixing member; and a controller configured to control an amount of the second electric power to control a heating value of the second heater, to determine whether the temperature of the fixing member is needed to be increased based on a variation of the temperature of the fixing member detected by the sensor, and to start supplying the first electric power to the first heater from the capacitor when the amount of the second electric power supplied to the second heater is of a greatest value and when the temperature of the fixing member is determined to be needed to be increased.

2. The image forming apparatus of claim 1, wherein the power source is a commercial power source.

3. The image forming apparatus of claim 1, wherein the first heater includes at least one heater element.

4. The image forming apparatus of claim 1, wherein the second heater includes at least one heater element.

5. The image forming apparatus of claim 1, wherein the controller is configured to determine that the temperature of the fixing member is needed to be increased when the temperature of the fixing member is detected by the sensor as being lowered.

6. The image forming apparatus of claim 1, wherein the controller is configured to supply the first electric power to the first heater from the capacitor during a time the second electric power is supplied to the second heater.

7. The image forming apparatus of claim 1, wherein the controller is configured to supply the first electric power to the first heater from the capacitor, regardless of whether the second electric power is supplied to the second heater.

8. The image forming apparatus of claim 1, wherein the controller is configured to vary an on-time duty in an on-and-off duty cycle of the second electric power to control the amount of the second electric power supplied to the second heater and to determine that the amount of the second electric power supplied to the second heater is of a greatest value when the on-time duty in the on-and-off duty cycle of the second electric power is varied to an allowable longest time period.

9. The image forming apparatus of claim 8, wherein the on-and-off duty cycle of the second electric power supplied to the second heater is greater than an on-and-off duty cycle of the first electric power supplied to the first heater.

10. An image forming apparatus, comprising:

means for forming a toner image on a recording sheet;

means for fixing the toner image onto the recording sheet with heat and pressure;

means for charging a capacitor with a first electric power using a power source;

first means for heating the means for fixing with the first electric power from the capacitor;

second means for heating the means for fixing with a second electric power from the power source;

means for detecting a temperature of the means for fixing;

means for controlling an amount of the second electric power to control a heating value of the second means for heating the means for fixing;

means for determining whether the temperature of the means for fixing is needed to be increased based on a variation of the temperature of the means for fixing detected by the means for detecting; and means for starting supplying the first electric power to the first means for heating from the capacitor when the amount of the second electric power supplied to the second means for heating is of a greatest value and when the temperature of the means for fixing is determined to be needed to be increased.

11. The image forming apparatus of claim 10, wherein the power source is a commercial power source.

12. The image forming apparatus of claim 10, wherein the first means for heating includes at least one heater element.

13. The image forming apparatus of claim 10, wherein the second means for heating includes at least one heater element.

14. The image forming apparatus of claim 10, wherein the means for determining determines that the temperature of the means for fixing is needed to be increased when the temperature of the means for fixing is detected by the means for detecting as being lowered.

15. The image forming apparatus of claim 10, wherein the means for starting starts supplying the first electric power to the first means for heating from the capacitor during a time the second electric power is supplied to the second means for heating.

16. The image forming apparatus of claim 10, wherein the means for starting starts supplying the first electric power to the first means for heating from the capacitor, regardless of whether the second electric power is supplied to the second means for heating.

17. The image forming apparatus of claim 10, further comprising means for varying an on-time duty in an on-and-off duty cycle of the second electric power to control the amount of the second electric power supplied to the second means for heating and means for deciding that the amount of the second electric power supplied to the second means for heating is of a greatest value when the on-time duty in the on-and-off duty cycle of the second electric power is varied to an allowable longest time period.

18. The image forming apparatus of claim 17, wherein the on-and-off duty cycle of the second electric power supplied to the second means for heating is greater than an on-and-off duty cycle of the first electric power supplied to the first means for heating.

19. An image forming method, comprising:

providing a first heater;

arranging a second heater;

charging a capacitor with a first electric power using a power source;

supplying a second electric power from the power source to the second heater;

heating a fixing member with the second electric power from the power source;

detecting a temperature of the fixing member;

controlling an amount of the second electric power to control a heating value of the second heater for heating the fixing member;

determining whether the temperature of the fixing member is needed to be increased based on a variation of the temperature of the fixing member detected by the detecting step; and starting supplying the first electric power to the first heater from the capacitor when the amount of the second electric power supplied to the second heater is of a greatest value and when the temperature of the fixing member is determined to be needed to be increased.

20. The image forming method of claim 19, wherein the power source is a commercial power source.

21. The image forming method of claim 19, wherein the first heater includes at least one heater element.

22. The image forming method of claim 19, wherein the second heater includes at least one heater element.

23. The image forming method of claim 19, wherein the determining step determines that the temperature of the fixing member is needed to be increased when the temperature of the fixing member is detected by the detecting step as being lowered.

24. The image forming method of claim 19, wherein the starting step starts supplying the first electric power to the first heater from the capacitor during a time the second electric power is supplied to the second heater.

25. The image forming method of claim 19, wherein the starting step starts supplying the first electric power to the first heater from the capacitor, regardless of whether the second electric power is supplied to the second heater.

26. The image forming method of claim 19, further comprising:

varying an on-time duty in an on-and-off duty cycle of the second electric power to control the amount of the second electric power supplied to the second heater; and deciding that the amount of the second electric power supplied to the second heater is of a greatest value when the on-time duty in the on-and-off duty cycle of the second electric power is varied to an allowable longest time period.

27. The image forming method of claim 26, wherein the on-and-off duty cycle of the second electric power supplied to the second heater is greater than an on-and-off duty cycle of the first electric power supplied to the first heater.

28. A heating apparatus, comprising:

a capacitor;

a charger configured to charge the capacitor with a first electric power using a power source;

a first heater configured to receive the first electric power from the capacitor and to heat a fixing member;

a second heater configured to receive a second electric power from the power source to heat the fixing member;

a sensor configured to detect a temperature of the fixing member; and a controller configured to control an amount of the second electric power to control a heating value of the second heater, to determine whether the temperature of the fixing member is needed to be increased based on a variation of the temperature of the fixing member detected by the sensor, and to start supplying the first electric power to the first heater from the capacitor when the amount of the second electric power supplied to the second heater is of a greatest value and when the temperature of the fixing member is determined to be needed to be increased.

29. An image fixing apparatus, comprising:

a fixing member configured to fix a toner image onto a recording sheet with heat and pressure;

a capacitor;

a charger configured to charge the capacitor with a first electric power using a power source;

a first heater configured to receive the first electric power from the capacitor and to heat the fixing member;

a second heater configured to receive a second electric power from the power source to heat the fixing member;

a sensor configured to detect a temperature of the fixing member; and a controller configured to control an amount of the second electric power to control a heating value of the second heater, to determine whether the temperature of the fixing member is needed to be increased based on a variation of the temperature of the fixing member detected by the sensor, and to start supplying the first electric power to the first heater from the capacitor when the amount of the second electric power supplied to the second heater is of a greatest value and when the temperature of the fixing member is determined to be needed to be increased.

30. The image fixing apparatus of claim 29, wherein the power source is a commercial power source.

31. The image fixing apparatus of claim 29, wherein the first heater includes at least one heater element.

32. The image fixing apparatus of claim 29, wherein the second heater includes at least one heater element.

33. The image fixing apparatus of claim 29, wherein the controller is configured to determine that the temperature of the fixing member is needed to be increased when the temperature of the fixing member is detected by the sensor as being lowered.

34. The image fixing apparatus of claim 29, wherein the controller is configured to supply the first electric power to the first heater from the capacitor during a time the second electric power is supplied to the second heater.

35. The image fixing apparatus of claim 29, wherein the controller is configured to supply the first electric power to the first heater from the capacitor, regardless of whether the second electric power is supplied to the second heater.

36. The image fixing apparatus of claim 29, wherein the controller is configured to vary an on-time duty in an on-and-off duty cycle of the second electric power to control the amount of the second electric power supplied to the second heater and to determine that the amount of the second electric power supplied to the second heater is of a greatest value when the on-time duty in the on-and-off duty cycle of the second electric power is varied to an allowable longest time period.

37. The image fixing apparatus of claim 36, wherein the on-and-off duty cycle of the second electric power supplied to the second heater is greater than an on-and-off duty cycle of the first electric power supplied to the first heater.

38. An image fixing apparatus, comprising:

means for fixing a toner image onto a recording sheet with heat and pressure;

means for charging a capacitor with a first electric power using a power source;

first means for heating the means for fixing with the first electric power from the capacitor;

second means for heating the means for fixing with a second electric power from the power source;

means for detecting a temperature of the means for fixing;

means for controlling an amount of the second electric power to control a heating value of the second means for heating the means for fixing;

means for determining whether the temperature of the means for fixing is needed to be increased based on a variation of the temperature of the means for fixing detected by the means for detecting; and means for starting supplying the first electric power to the first means for heating from the capacitor when the amount of the second electric power supplied to the second means for heating is of a greatest value and when the temperature of the means for fixing is determined to be needed to be increased.

39. The image fixing apparatus of claim 38, wherein the power source is a commercial power source.

40. The image fixing apparatus of claim 38, wherein the first means for heating includes at least one heater element.

41. The image fixing apparatus of claim 38, wherein the second means for heating includes at least one heater element.

42. The image fixing apparatus of claim 38, wherein the means for determining determines that the temperature of the means for fixing is needed to be increased when the temperature of the means for fixing is detected by the means for detecting as being lowered.

43. The image fixing apparatus of claim 38, wherein the means for starting starts supplying the first electric power to the first means for heating from the capacitor during a time the second electric power is supplied to the second means for heating.

44. The image fixing apparatus of claim 38, wherein the means for starting starts supplying the first electric power to the first means for heating from the capacitor, regardless of whether the second electric power is supplied to the second means for heating.

45. The image fixing apparatus of claim 38, further comprising means for varying an on-time duty in an on-and-off duty cycle of the second electric power to control the amount of the second electric power supplied to the second means for heating and means for deciding that the amount of the second electric power supplied to the second means for heating is of a greatest value when the on-time duty in the on-and-off duty cycle of the second electric power is varied to an allowable longest time period.

46. The image fixing apparatus of claim 45, wherein the on-and-off duty cycle of the second electric power supplied to the second means for heating is greater than an on-and-off duty cycle of the first electric power supplied to the first means for heating.

47. An image fixing method, comprising:

providing a first heater;

arranging a second heater;

charging a capacitor with a first electric power using a power source;

supplying a second electric power from the power source to the second heater;

heating a fixing member with the second electric power from the power source;

detecting a temperature of the fixing member;

controlling an amount of the second electric power to control a heating value of the second heater for heating the fixing member;

determining whether the temperature of the fixing member is needed to be increased based on a variation of the temperature of the fixing member detected by the detecting step; and starting supplying the first electric power to the first heater from the capacitor when the amount of the second electric power supplied to the second heater is of a greatest value and when the temperature of the fixing member is determined to be needed to be increased.

48. The image fixing method of claim 47, wherein the power source is a commercial power source.

49. The image fixing method of claim 47, wherein the first heater includes at least one heater element.

50. The image fixing method of claim 47, wherein the second heater includes at least one heater element.

51. The image fixing method of claim 47, wherein the determining step determines that the temperature of the fixing member is needed to be increased when the temperature of the fixing member is detected by the detecting step as being lowered.

52. The image fixing method of claim 47, wherein the starting step starts supplying the first electric power to the first heater from the capacitor during a time the second electric power is supplied to the second heater.

53. The image fixing method of claim 47, wherein the starting step starts supplying the first electric power to the first heater from the capacitor, regardless of whether the second electric power is supplied to the second heater.

54. The image fixing method of claim 47, further comprising:

varying an on-time duty in an on-and-off duty cycle of the second electric power to control the amount of the second electric power supplied to the second heater; and deciding that the amount of the second electric power supplied to the second heater is of a greatest value when the on-time duty in the on-and-off duty cycle of the second electric power is varied to an allowable longest time period.

55. The image fixing method of claim 54, wherein the on-and-off duty cycle of the second electric power supplied to the second heater is greater than an on-and-off duty cycle of the first electric power supplied to the first heater.

* * * * *